United States Patent [19]

Scott

[11] 4,112,251

[45] Sep. 5, 1978

[54] SCREW-ON WIRE CONNECTOR AND METHOD OF MAKING IT

[75] Inventor: William J. Scott, Sycamore, Ill.

[73] Assignee: Ideal Industrie, Inc., Sycamore, Ill.

[21] Appl. No.: 602,440

[22] Filed: Aug. 6, 1975

Related U.S. Application Data

[63] Continuation of Ser. No. 162,533, Jul. 14, 1971, abandoned.

[51] Int. Cl.[2] ..... H01R 5/12

[52] U.S. Cl. ..... 174/87; 29/456; 29/629; 228/145

[58] Field of Search ..... 174/87, 84 R, 84 S, 174/94 R, 94 S, 200, 203, 204, 205, 206; 85/32 CS, 35; 151/14 CS; 29/628, 629, 456; 339/67, 95 A, 95 B, 95 R, 201, 202, 114, 115 R, 116 R, 232; 16/109; 113/121 A; 215/329; 140/76; 228/145; 403/361, 365, 372

[56] References Cited

U.S. PATENT DOCUMENTS

| | | | |
|---|---|---|---|
| 1,472,518 | 10/1923 | Gillette et al. | 29/456 UX |
| 1,874,825 | 8/1932 | Sommer | 174/87 |
| 2,040,383 | 5/1936 | Jasper | 174/87 |
| 2,084,568 | 6/1937 | White | 85/35 UX |
| 2,093,810 | 9/1937 | Karmazin | 85/32 CS UX |
| 2,387,257 | 10/1945 | Haas | 151/14 CS |
| 2,748,186 | 5/1956 | Lee | 174/87 |
| 2,844,806 | 7/1958 | McKissick | 339/95 B X |
| 2,965,700 | 12/1960 | Kusiv | 174/87 |
| 3,107,022 | 10/1963 | Wandell | 215/329 |
| 3,132,202 | 5/1964 | Wolf | 174/87 |
| 3,272,369 | 9/1966 | Grimsley | 215/329 |
| 3,544,953 | 12/1970 | Shannon | 339/116 R |
| 3,616,532 | 11/1971 | Beck | 174/68.5 X |
| 3,663,927 | 5/1972 | Bruner | 339/95 B |

FOREIGN PATENT DOCUMENTS

| | | | |
|---|---|---|---|
| 238,017 | 8/1925 | United Kingdom | 174/205 |

*Primary Examiner*—Laramie E. Askin

*Attorney, Agent, or Firm*—Kinzer, Plyer, Dorn & McEachran

[57] ABSTRACT

A method of joining the stripped ends of electrical wires and screw-on connectors for performing the method. The method includes bunching the stripped ends of wire, inserting the bunched wires into a distortable relatively nonexpandable wire retainer having an inwardly tapered thread, rotating the wires and wire retainer relative to one another to feed the bunched wires into the wire retainer, applying torque to the bunched wires and the wire retainer to cause the wire retainer to compress the wires into contact with one another and form a thread thereon, supporting the wire retainer during application of the torque in a manner which permits the wire retainer to freely distort without substantial expansion to thereby accommodate the wires as the wires are forced into the small end of the tapered thread, and covering the wire retainer and retained wire with an insulator. A screw-on wire connector which includes an insulating cap with a bore open at one end for the reception of the stripped ends of the wires. A distortable relatively non-expandable wire retainer which receives the wires is located in the cap. The wire retainer is of various forms each of which has a tapered thread which engages the inserted wires. The wire retainer is spaced circumferentially from the inside of the wall between its ends to provide for circumferential distortion of the retainer by the wires without placing an outward load on the cap due to substantial contact between the retainer and the cap.

33 Claims, 9 Drawing Figures fig.1.
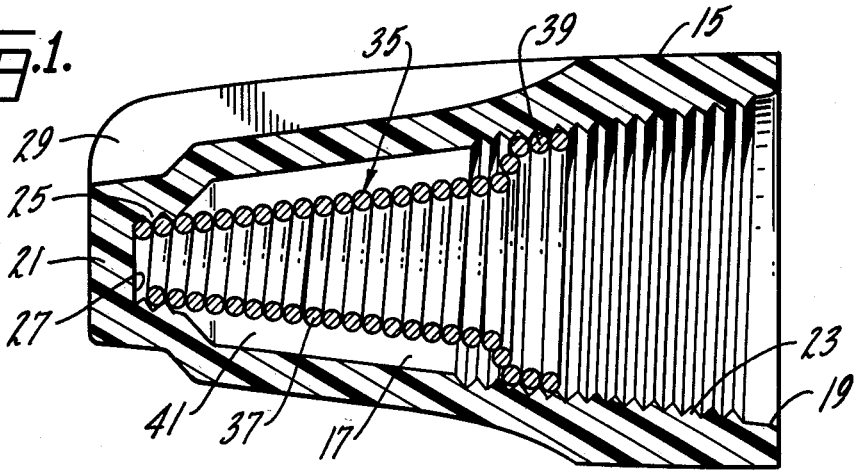
fig.2.
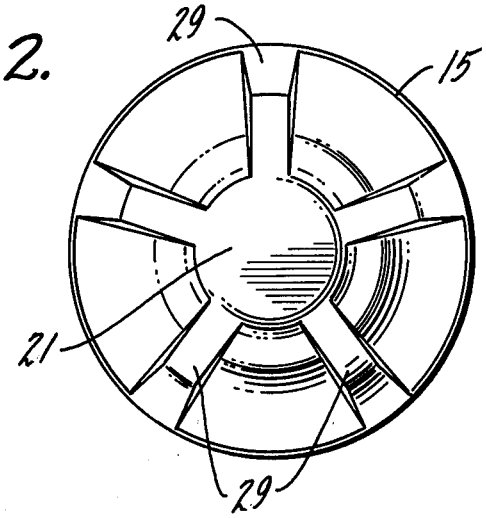
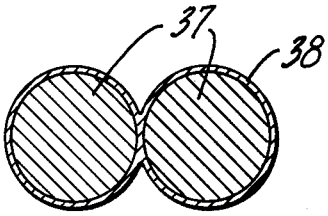
fig.4.
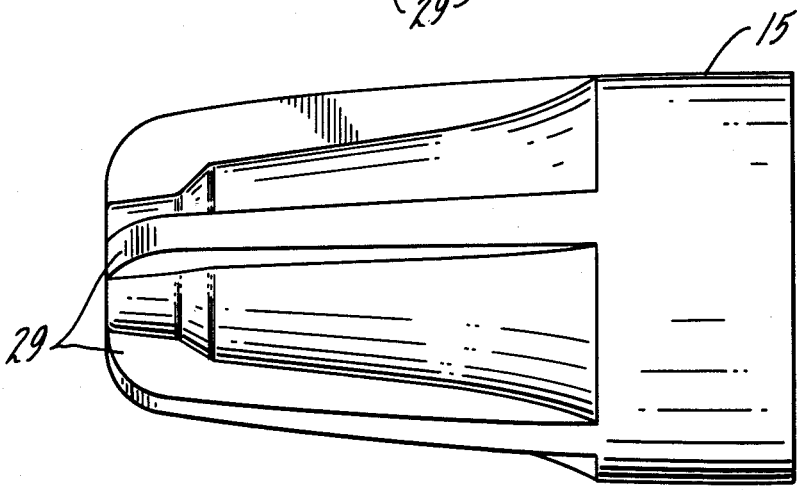
fig.3.

fig.5.
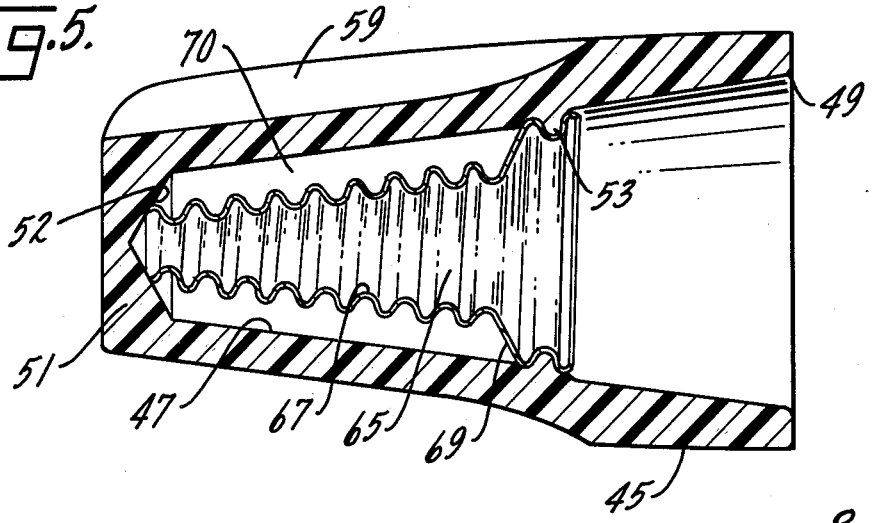
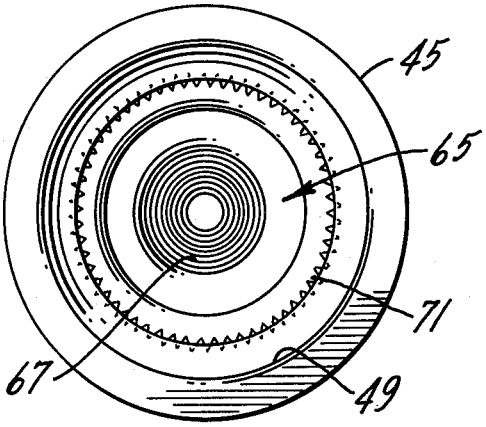
fig.6.
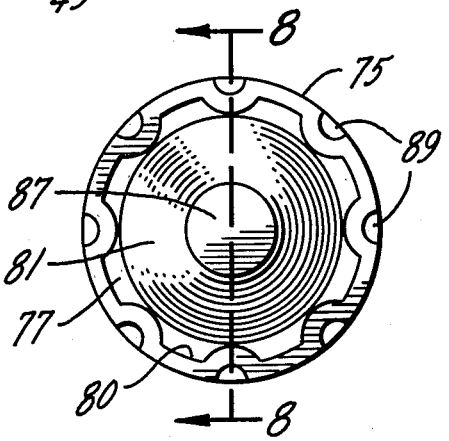
fig.7.
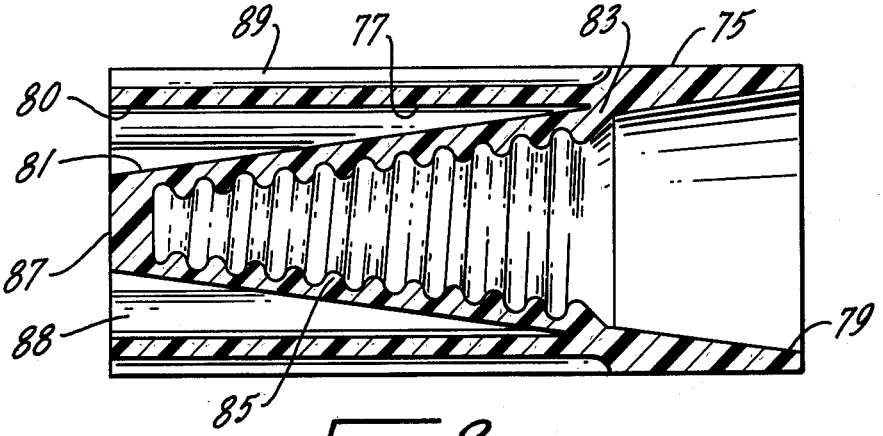
fig.8.

SCREW-ON WIRE CONNECTOR AND METHOD OF MAKING IT

This is a continuation of Ser. No. 162,533, filed July 14, 1971, now abandoned.

SUMMARY OF THE INVENTION

This invention is concerned with a method of making an electrical connection and a screw-on connector for performing the method.

An object of this invention is a method of making a connection in which the bursting forces exerted by the wires being connected are absorbed by distortion of a wire retainer.

Another object is a method of making an electrical connection between the stripped ends of electrical wires in which the forces exerted by the electrical wires being connected are not transferred to the insulating means of the finished connection.

Another object is an electrical connector having an insulating cap in which the insulating cap does not absorb the bursting forces exerted by the wires being connected.

Another object is an electrical connector of the screw-on type in which the insulating cap may be formed with relatively thin walls and has a relatively small volume for the size of the connection.

Another object is an electrical connector having characteristics equal to those of a so-called "free spring" connector but which does not require the high strength and high quality wire used in a "free spring" connector.

Another object is an electrical connector of the screw-on type in which the wire connecting portion is not dependent upon the insulating portion for strength or form.

Another object is an electrical connector of the screw-on type which provides a wire connection of smaller volume than other types of screw-on connectors.

Another object is an electrical connector of the screw-on type which may be reused on any combination of wires within the design capability of the connector.

Another object is an all plastic screw-on electrical connector having a deformable portion spaced from the insulating portion and which absorbs the bursting forces exerted by the wires being connected.

Another object is an electrical connector of the screw-on type having a sheet metal wire retainer.

Another object is an electrical connector of the screw-on type having a brazed, closely turned spring type wire retainer.

Other objects may be found in the following specification, claims and drawings.

BRIEF DESCRIPTION OF THE DRAWINGS

The invention is illustrated more or less diagrammatically in the following drawings wherein:

FIG. 1 is a longitudinal cross-sectional view taken through a screw-on wire connector embodying the novel features of this invention;

FIG. 2 is an end view of the connector of FIG. 1;

FIG. 3 is a plan view of the connector of FIG. 1;

FIG. 4 is an enlarged cross-sectional view of a portion of the wire retainer of FIG. 1;

FIG. 5 is a longitudinal cross-section view of a modified form of screw-on connector;

FIG. 6 is a view of the open end of the connector of FIG. 5 having a modified wire retainer;

FIG. 7 is an end view of yet another modified form of connector;

FIG. 8 is a longitudinal cross-sectional view taken along line 8—8 of FIG. 7.

DESCRIPTION OF THE PREFERRED EMBODIMENTS

Figure 9:
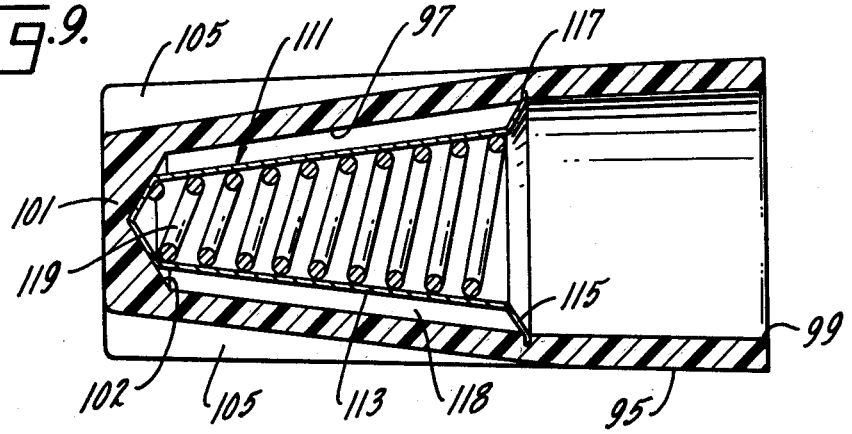
FIG. 9 is a longitudinal cross-sectional view of yet another modified form of connector.

One embodiment is shown in FIGS. 1–4 of the drawings. This connector includes an insulating cap or shell 15 which may be molded from a suitable thermosetting or thermoplastic material or any suitable insulating material. A cavity or bore 17 is formed in the cap and the cavity tapers from an opening 19 at one end to a wall 21 closing the opposite end of the cap. Threads 23 may be formed in part of the bore commencing adjacent the opening. Threads 25 may also be formed in a recess 27 located at the end of the bore adjacent the end wall 21. Longitudinally extending ribs 29 may be formed on the exterior of the cap 15.

A retainer 35 is positioned in the bore 17 with one end of the wire retainer seated in the recess 27 adjacent the end wall 21 of the cap and the other end seated in the threads 23. In this embodiment, the retainer 35 is formed from a conical-shaped, closely wound wire or spring which is furnace brazed or soldered so that the turns 37 thereof are coated at 38 and joined into an integral structure. The retainer is formed with a bell portion 39 at its larger end. The bell portion seats in the threads 23 of the cap to space the conical portion of the retainer away from the wall of the cap thereby providing an open air space 41 all the way around or substantially so.

Another embodiment is shown in FIGS. 5 and 6 of the drawings. This connector includes an insulating cap or shell 45 which may be molded from a suitable thermosetting or thermoplastic or any suitable insulating material. A cavity or bore 47 is formed in the cap and tapers from an opening 49 at one end to a wall 51 closing the opposite end of the cap. A conical recess 52 may be formed in the wall 51 at the end of the bore. An annular ridge 53 may be formed in the bore inwardly of the opening 49. Longitudinally extending ribs 59 are formed on the exterior of the cap 45.

A sheet metal retainer 65 is positioned in the bore 47 with one end contacting the cone 52 in the end wall 51 of the cap and the other end seated on ridge 53. In this form, the retainer 65 is a generally frusto-conical shaped tubular member drawn from thin sheet metal and provided with rolled or hydraulically formed threads 67. The retainer is formed with a bell portion 69 at its larger end which engages the annular ridge 53 to support the main portion of the retainer in spaced relation to the wall of the cap 45 thereby creating a generally annular air space 70. The smaller end of the retainer 65 engages and is supported by the end wall 51 of the insulating cap in the conical recess 52. The bell portion of the wire retainer may be grooved or threaded to engage the ridge 53 or, as shown in FIG. 6 of the drawings, it may be provided with serrations 71. The serrations are particularly useful in attaching a wire retainer to a thermoplastic insulating cap since the serrated portion of the wire retainer may be fused to the insulating cap by means of heat or ultrasonics.

Another embodiment is shown in FIGS. 7 and 8 of the drawings. This form of connector includes an insulating cap or shell 75 which may be molded from a suitable insulating material. A cavity or bore 77 is formed in the cap and extends from a wire-receiving opening 79 at one end thereof to an opening 80 at the opposite end. A generally frusto-conical shaped retainer 81 is located in the bore 77 and may be formed integrally with the cap 75. The retainer is attached at its larger end to the cap at 83 adjacent the wire receiving opening 79. The wire retainer has tapered, inner threads 85 extending from its larger end to an end wall 87 located at the smaller end of the retainer. The frusto-conical shape of the wire retaining portion provides a space 88 between the wire retainer and the wall of the cap 75. The outer surface of the insulating cap may be fluted at 89 to provide a gripping surface.

Another embodiment is shown in FIG. 9 of the drawings. This connector includes an insulating cap or shell 95 which may be molded from a suitable insulating material. A cavity or bore 97 is formed in the cap and tapers from an opening 99 at one end of the cap to a wall 101 closing the opposite end. A conical recess 102 may be formed in the wall 101 at the end of the bore. Longitudinally extending ribs 105 may be formed on the exterior of the cap.

A retainer 111 is positioned in the bore 97 with one end seated in the recess 102 and engaging the end wall 101 and the other end contacting the wall of the inner cap. The retainer 111 is formed as a thin sheet metal drawn cup of generally frusto-conical shape. The retainer is closed at its smaller end and is open at its larger end. A bell 113 is formed at the open end with a flange 115 which is imbedded as at 117 in the cap 95 by heat, ultrasonics or the like to provide an air space 118. An open pitch, cone-shaped spring or coil 119 is positioned in the cup 111 and is fastened thereto by brazing, by a suitable adhesive or the like. The spring provides a thread for the wires which will be inserted in the retainer.

The use, operation and function of this invention are as follows.

This invention is directed to a method of making an electrical connection between the stripped ends of insulated electrical wires. It is also concerned with several forms of a new connector. In practice, the stripped ends of the wires are first bunched. The bunched stripped ends of the wires are then inserted in a distortable, relatively nonexpandable retainer having inwardly tapered threads. The retainer is suitably supported so that it may freely distort without contacting its support. The retainer is constructed so that it will distort or deform without substantial expansion. This may be accomplished by supporting the retainer in a wrench. Or the supporting member for the retainer may be in the shape of an insulating cap with the retainer and cap forming a unitary connector.

When the bunched ends of the wires are inserted in the retainer, the wires and the retainer are rotated relative to one another to feed the bunched wires into the retainer. During rotation, torque is applied to cause the retainer to compress the wires into contact with one another and to form a thread on them. During application of torque, the retainer freely distorts without substantial expansion to accommodate the wires as the bunched ends of the wires are forced into the small end of the retainer. The bursting forces exerted by the wires as they are compressed are absorbed by the distortion of the retainer and are not transmitted to the holder or shell. When the connection is made, the wires and the retainer may be covered with an insulator, although in some situations the provision of an insulator may not be necessary. Or the holder may also serve as an insulator.

This method may be practiced by the use of any of the screw-on wire connectors which have been shown and described herein. The connector cap functions to support the retainer during insertion of the stripped ends of the bunched wires into the retainer. Also, the insulator cap eliminates the additional step of covering the joined wires and wire retainer with an insulator. When an insulator cap is provided as part of a screw-on connector, an air space is provided between the wire and the cap. It may be desirable in some situations to place a resilient material in the air space. The tendency of the retainer to deform may be varied by controlling the section thickness, section shape, material hardness, material strength, or diameter of the material forming the wire retainer or the included angle of the cone-shaped wire retainer. Also, the nature of the conductors being joined will affect the tendency of the retainer to deform.

Retainers of the types shown and described herein are not dependent upon the insulating caps of their connectors for strength or form. In prior art connectors in which a helically wound spring is directly supported throughout by an insulating cap, the cap or shell is required to be excessively strong to resist the considerably bursting forces developed by screwing the wires into the helically wound spring. The manufacture of such a connector requires thick sections in the insulating cap which are difficult to mold. An insulator cap with thick sections also occupies a larger cubic volume than the volume required by the connector of this invention. This presents problems in small outlet and device boxes.

The connector of this invention also provides advantages not found in the so-called free spring connector where the insulating cap does not radially support the spring and the spring is free to expand radially and contract longitudinally as the wires are inserted. However, the free spring connector requires a wire of greater strength and quality and consequently greater cost than the wire necessary for the connector of this invention. Further, free spring connectors now in use are made from nonround wire which presents a small radius to the wires being connected. This also adds to the cost of the free spring connector and increases the difficulty in forming the spring or wire retainer. Also, the free spring connector will generally have the spring or wire retainer stretched beyond its elastic limit in the process of making a connection so that the connector cannot be reused on a joint with a smaller circular mil area.

Various examples of distortable or deformable, generally nonexpandable retainers have been shown and described. Wire retainer 35 of FIG. 1 is formed from a close wound wire spring which is then furnace brazed or soldered so that the turns are joined into an integral structure. The wire retainer 65 of FIG. 5 is a threaded sheet metal cup which may be formed by an electrical field of force, hydraulics, high energy rate forming, spinning, hot forging, cold forging or cold forming and brazing. A third type of retainer 111 is shown in FIG. 9 which may be made by cementing a wire form 119 into a metal cup 113. It should also be understood that whereas several forms of the all metal wire retainer have been shown, these examples are by way of illustration and not limitation. For example, in certain situations and for certain applications, the wire retainer may be made by investment casting or sintering or interior tapered threads may be machined after the wire retainer is formed in one of the methods previously mentioned.

The wire retainer 35 of FIG. 1 is fabricated from round steel wire into the generally frusto-conical spring shown. However, wire having other cross sections such as square, tear-drop, cigar-shaped, hexagon, elongated hexagon, triangular, deformed pentagon, oval or flat with shaped edges may be used. The spring is then copper plated, furnace brazed and then zinc plated for corrosion resistance before being assembled into the shell 15. The brazing operation joins the turns of the spring into an integral structure while fully annealing the steel of the spring. The spring is joined to the insulator cap 15 by means of the threads 23 in the cap matching the turns 37 of the spring. The spring may be prevented from unthreading by a small tangential extension of the wire at the bell end 39 of the spring retainer. Wire retainers of the types shown in FIGS. 5 and 9 may be adapted to "freewheel" in the insulating cap to prevent disconnecting of the inserted wires when this is desired. The small ends of the wire retainers may be closed completely or at least restricted to prevent the inserted wires from being forced through the retainers and into contact with the insulator caps. The insulator caps can be formed with walls as thin and as uniform in thickness as possible to reduce the material used and the molding time.

The all plastic connector shown in FIG. 8 of the drawings has a wire retainer 81 formed integrally with the insulating cap 75. A thermosetting or thermoplastic material may be used but the material must have the ability to be visibly deflected within the elastic limit while having the ability to form threads in normal conductor materials such as copper and aluminum. The all plastic connector may be formed by any one of the known methods of forming plastics such as molding, hot-forming, spin-forming, vacuum-forming, sintering, casting, cementing, lay-up, machining, etc.

One of the advantages of the present invention is that the method of manufacture is greatly simplified and a number of functions can be acquired in one step. For example in the form shown in FIGS. 1 and 9 where a wire coil is used, the coil can initially be made from relatively stiff wire which is much easier to control and more accurate during bending and coiling. With the brazing material applied to it, in the brazing furnace it can be raised to a sufficiently high temperature so that the stiff wire, which is too stiff to distort, will be simultaneously annealed while it is brazed. Annealing makes the wire much more flexible so that, in use, it will distort to conform to the bundle of wires it is being screwed on but, due to the brazing, will not expand to any appreciable extent. This is true of either FIG. 1 or FIG. 9 where, in either, the heat will simultaneously braze and anneal. This is true whether the finished connector is thereafter enclosed in an insulating cap or as applied by a wrench and separately insulated such as by tape or what-have-you. If the wire remains stiff and is not annealed, the resulting connector will be much more difficult, if not impossible, to apply to the stripped ends of the wires, particularly by hand.

Whereas the preferred method and several preferred forms of the invention have been described and shown, it should be understood that there are modifications, alterations and changes which may be made without departing from the teachings of the invention. Therefore, the scope of the invention should be only limited by the claims attached hereto.

The embodiments of the invention in which an exclusive property or privilege is claimed are defined as follows:

1. In a connector assembly for joining the stripped ends of two or more electrical wires, an insulating cap with a hollow interior generally open at one end for the reception of the stripped ends of the wires, and a distortable relatively nonexpandable tapered retainer with a thread-forming surface therein for receiving the ends of the wires located in the cap and in contact with the inside wall of the cap at least at one end and spaced circumferentially from the inside wall of the cap between its ends to provide for circumferential distortion of the retainer by the wires without placing an outward load on the cap due to substantial contact between the retainer and the cap.

2. The connector assembly of claim 1 further characterized in that the retainer is provided with tapered threads adapted to engage the stripped ends of the wires.

3. The connector assembly of claim 1 further characterized in that the retainer is a coiled spring with the turns thereof joined to form an integral structure.

4. The connector assembly of claim 3 further characterized in that the coil spring is conical and the turns are joined by brazed material.

5. The connector assembly of claim 3 further characterized in that the turns are joined by solder material.

6. The connector assembly of claim 1 further characterized in that the retainer is cup-shaped, is formed separately from the insulating cap and is fastened against rotation relative to the cap.

7. The connector assembly of claim 6 further characterized in that the retainer is conical.

8. The connector assembly of claim 6 further characterized in that the cup-shaped retainer includes tapered wire-engaging threads on the interior thereof.

9. The connector assembly of claim 6 further characterized in that tapered threads are provided inside the cup-shaped retainer and are joined to the retainer cup to form an integral structure.

10. The connector assembly of claim 1 further characterized in that the retainer is cup-shaped and is formed integrally with the insulating cap.

11. The connector assembly of claim 10 further characterized in that the retainer is conical.

12. The connector assembly of claim 10 further characterized in that the cup-shaped retainer includes tapered wire-engaging threads on the interior thereof.

13. The connector assembly of claim 10 further characterized in that the retainer is conical and connects integrally at its larger end to the insulating cap.

14. In an electrical connector for joining the stripped ends of two or more electrical wires, a circumferentially distortable relatively nonexpandable retainer for receiving the stripped ends of the wires and being generally tapered between an open larger end and a closed smaller end with an open interior therebetween, a thread-forming surface on the open interior of the retainer, and exterior means on the retainer for transmitting wire connecting torque to the retainer to cause the thread-forming surface on the open interior thereof to be turned down on and thread the stripped ends of the wires.

15. The structure of claim 14 further characterized in that the exterior means includes an insulating cap which is open at one end and closed at the other end.

16. The structure of claim 14 further characterized in that the retainer includes a coiled wire with the adjacent turns thereof joined to each other forming an integral structure.

17. The structure of claim 16 further characterized in that the turns of the coiled wire are joined by brazed material.

18. The structure of claim 14 in which the retainer and exterior means are integral and made of plastic.

19. The structure of claim 18 further characterized in that the retainer is in the form of a generally tapered cap and the exterior means includes a generally cylindrical skirt in spaced relation throughout most of its length from the exterior of the cap and integrally joined thereto at a point spaced from the large open end of the cap.

20. The structure of claim 19 further characterized by and including threads integrally formed on the inner surface of the cap.

21. The structure of claim 20 further characterized in that the threads are only formed on the inner surface of the cap in the portion thereof that is overlapped by and in spaced relation to the skirt.

22. The structure of claim 18 further characterized in that the exterior means is in the form of a generally cylindrical shell open at both ends, and the retainer is in the form of a cone integrally attached at its large end to the inner surface of the shell at a point between the ends thereof.

23. The structure of claim 14 in which the exterior means includes a generally tapered cone open at its large end and closed at its small end, and the retainer includes a thin sheet metal taper with a wire coil on the inner surface thereof and joined thereto.

24. The structure of claim 23 in which the turns of the wire coil are spaced from each other.

25. The structure of claim 23 further characterized in that the turns of the wire coil are joined to the sheet metal taper by brazed material.

26. The structure of claim 23 in which the sheet metal taper is closed at its small end so as to be in the shape of a cup.

27. A method of making an electrical connector of the screw-on type, including the steps of winding a relatively stiff wire into a tapered coil, applying brazing material to the coil, heating the coil to a sufficient temperature such that the wire of the coil will be annealed sufficiently so that the turns will distort without expanding as it is screwed onto the ends of two or more wires and, at the same time, the brazing material will fuse the coil into a relatively solid structure, and thereafter enclosing the coil in an insulating plastic shell.

28. The method of claim 27 further characterized in that the wire is initially wound into a plurality of connecting turns so that the brazing material will fuse the turns to each other.

29. A method of making an electrical connector of the screw-on type, including the steps of winding a relatively stiff wire into a tapered coil with a plurality of spaced turns, enclosing the coil in a metal sleeve, applying brazing material to the coil and sleeve, heating the coil to a sufficient temperature such that the wire of the coil will be annealed sufficiently so that the turns will be distorted without expanding as it is screwed onto the ends of two or more wires and, at the same time, the brazing material will fuse the coil into a relatively solid structure, and thereafter enclosing the coil and sleeve in an electrical insulating shell.

30. The method of claim 29 further characterized in that the metal sleeve is generally tapered, closed at its small end and open at its large end.

* * * * *